United States Patent [19]

Ban

[11] Patent Number: 5,014,400

[45] Date of Patent: May 14, 1991

[54] ORNAMENTAL SNAP FASTENERS

[75] Inventor: Tadahiko Ban, Tokyo, Japan

[73] Assignee: Kabushiki Kaisha Baarei, Tokyo, Japan

[21] Appl. No.: 506,474

[22] Filed: Apr. 9, 1990

[30] Foreign Application Priority Data

Apr. 12, 1989 [JP] Japan ..... 1-92055

[51] Int. Cl.[5] ..... A44B 1/38

[52] U.S. Cl. ..... 24/108; 24/90 A

[58] Field of Search ..... 24/108, 109, 104, 90 A, 24/6; 411/508, 510, 339, 526

[56] References Cited

U.S. PATENT DOCUMENTS

| | | | |
|---|---|---|---|
| 208,753 | 10/1878 | Michelson | 24/104 |
| 1,548,621 | 8/1925 | London | 24/108 |
| 2,213,715 | 9/1940 | Monahan | 24/90 A |
| 2,843,903 | 7/1958 | Chaves | 24/109 |
| 3,538,556 | 11/1970 | Shein | 24/90 A |
| 3,643,296 | 2/1972 | Kahn | 24/108 |
| 3,643,987 | 2/1972 | Du Pont | 411/526 |
| 3,689,962 | 9/1972 | Erickson | 24/108 |

FOREIGN PATENT DOCUMENTS

| | | | |
|---|---|---|---|
| 867888 | 5/1961 | United Kingdom | 24/108 |

*Primary Examiner*—Victor N. Sakran

*Attorney, Agent, or Firm*—Morrison Law Firm

[57] ABSTRACT

A snap fastener includes a neck on a male component thereof having a non-circular cross section. A female component includes slots in a receptacle that engage the neck of the male component. This engagement prevents relative rotation of the male and female components. A removable ornament may be affixed to either the male or female component to permit attachment to a garment or bag without allowing the ornament to rotate.

6 Claims, 4 Drawing Sheets

FIG. 6
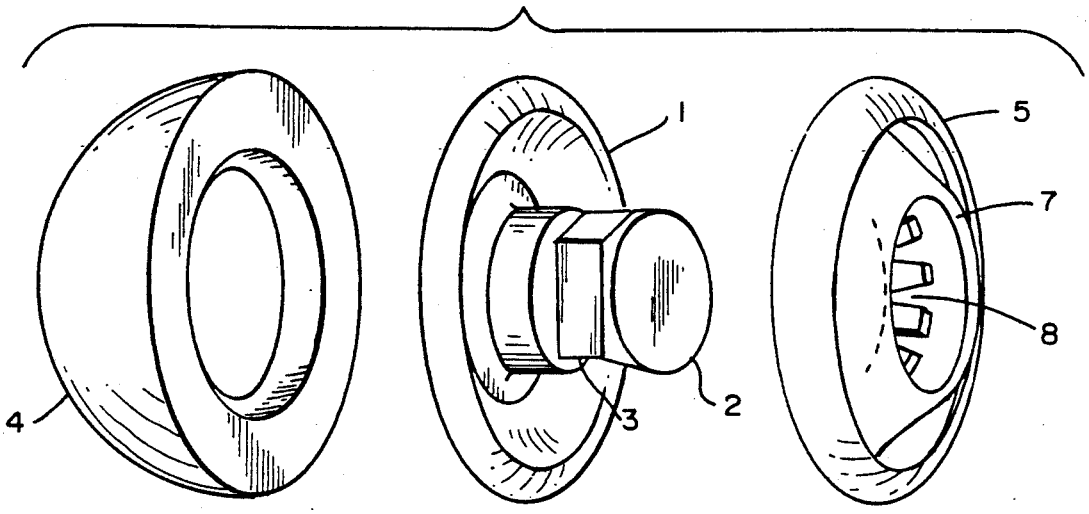
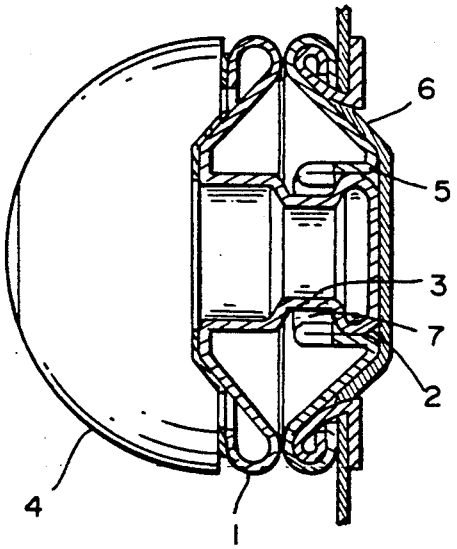
FIG. 7A
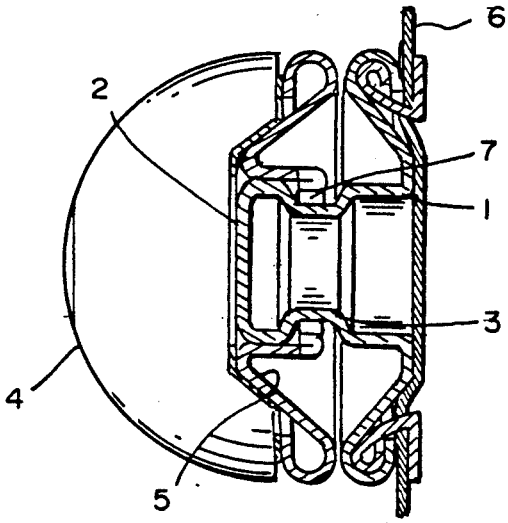
FIG. 7B

ORNAMENTAL SNAP FASTENERS

BACKGROUND OF THE INVENTION

The present invention relates to snap fasteners that are commonly used to fasten together or close separable parts of a garment or bag. More particularly, it relates to the use of these snap fasteners to secure fully independent or interchangeable ornaments or attachments to a garment or bag.

Snape fasteners, which are typically used as convenient means to close the front of a coat or otherwise to attach two sections of a garment together, are made up of male and female components. Each male component consists of a body that supports a fitting protrusion attached to it by a cylindrical neck. Each female component consists of a body that supports a fitting receptacle that is surrounded by a slotted ring. Attachment is accomplished by forcing the fitting protrusion of the male component through the slotted ring into the receptacle of the female component.

One problem with conventional snap fasteners arises due to the generally circular cross sections of the interfitting parts. Such circular cross sections permit relative rotation between the elements connected to the male and female components. In the case of clothing, such relative rotation is not a problem. However, when an independent ornament, or other element is to be connected to a garment or bag, such rotation may be undesirable.

SUMMARY OF THE INVENTION

An object of the present invention is to provide snap fasteners that are advantageous not only for closing or securing separable parts of a garment or bag, but also for the attachment of fully independent ornaments or other attachments.

Another object is to provide a snap fastener whose male and female components cannot rotate with respect to each other. The present invention utilizes a male component, which, because it has a non-circular cross section, prevents the snap section that supports the attached ornaments from rotating relative to the female component, thereby assuring their proper orientation.

Briefly stated, the present invention provides a snap fastener that includes a neck on a male component thereof having a non-circular cross section. A female component includes slots in a receptacle that engage the neck of the male component. This engagement prevents relative rotation of the male and female components. A removable ornament may be affixed to either the male or female component to permit attachment to a garment or bag without allowing the ornament to rotate.

According to an embodiment of the invention, there is provided a snap fastener comprising: a male component, the male component including a fitting projection, a neck connecting the fitting projection to a remainder of the male component, the neck having a non-circular cross section, a female component, a receptacle in the female component for receiving the fitting projection, the receptacle including at least one element for engaging the neck, and the at least one element including means for preventing the male component for rotating with respect to the receptacle.

According to a feature of the invention, there is provided apparatus for decorating a fabric comprising: a snap fastener, a male component of the snap fastener, the male component including a fitting projection, a neck connecting the fitting projection to a remainder of the male component, the neck having a non-circular cross section, a female component of the snap fastener, a receptacle in the female component for receiving the fitting projection, the receptacle including at least one element for engaging the neck, the at least one element including means for preventing the male component from rotating with respect to the receptacle, an ornament, and means for affixing the ornament to one of the male component and the female component, the means for affixing including means for preventing rotation of the ornament with respect to the component to which it is affixed, whereby the ornament is affixable to the fabric with a selected, non-rotating, orientation.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 6 is an exploded view of one embodiment of the present invention in a typical configuration with an ornament to be attached.

FIG. 7A is a side view, partially in cross section, of a snap fastener in which an ornament is secured to a male component for attachment to the fabric of a garment or bag.

FIG. 7B is side view, partially in cross section, of a snap fastener in which an ornament is secured to a female component for attachment to the fabric of a garment or bag.

DETAILED DESCRIPTION OF THE PREFERRED EMBODIMENTS

Figure 1:
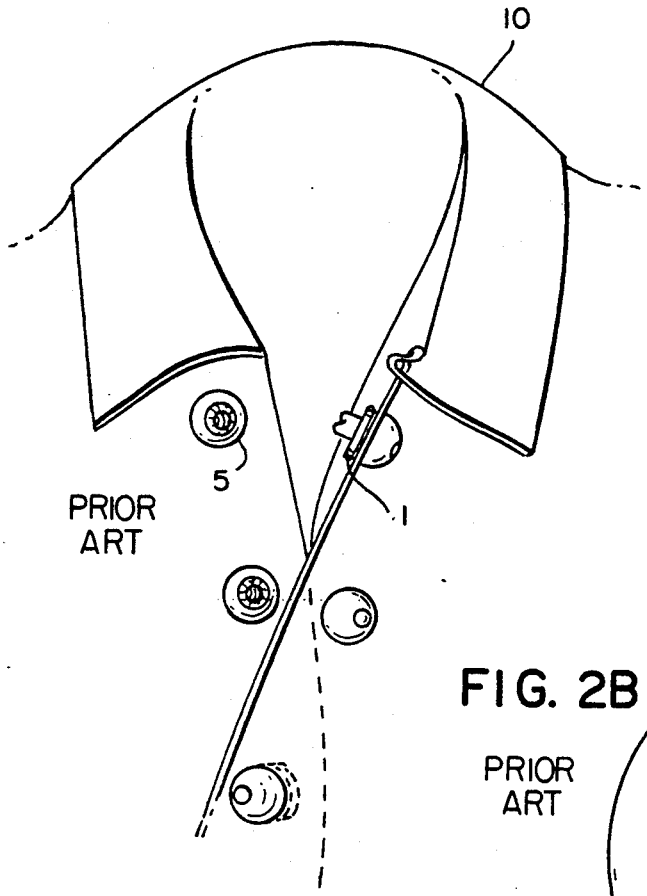
FIG. 1 is a front view of a portion of a garment fitted with conventional snap fasteners.

Referring to FIG. 1, a female component 5 and a male component 1 of a conventional snap fastener are securely attached to the separable components of a garment 9 that they are to join. In this arrangement, both components of the snap fastener are prevented from turning by their connection to the fabric of the garment.

Figure 2A:
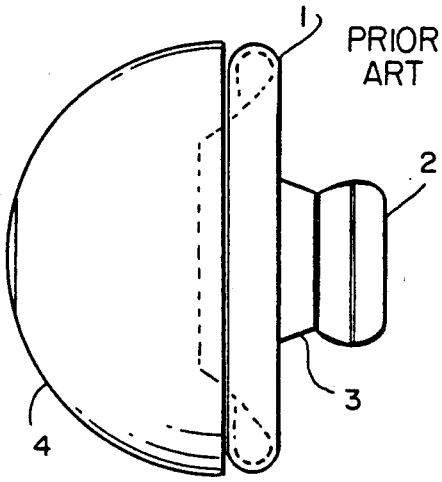
FIG. 2A is a side view of the male component of a conventional snap fastener.

Referring to FIG. 2A, a neck 3, that attaches a fitting projection 2 to the male component 1 of a conventional snap fastener, has a circular cross section. The circular cross section allows free relative rotation between the components unless both are secured to fabric as in FIG. 1. When a conventional snap fastener is used to attach a removable ornament 4 to a garment or bag, only the component secured permanently to the fabric of the garment or bag is prevented from turning. Therefore, the component of a conventional snap fastener to which the removable ornament 4 is attached can rotate freely with its attached ornament. For this reason, the conventional snap fastener cannot maintain the required orientation of the ornament to the garment or bag to which it is attached.

Figure 2B:
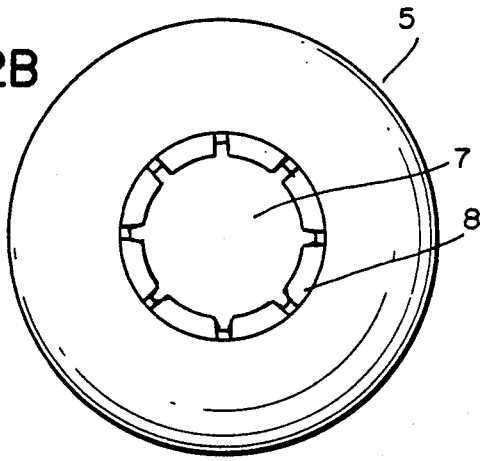
FIG. 2B PRIOR ART
FIG. 2B is a front view of the female component of a conventional snap fastener showing the slotted ring and receptacle.
Figure 3:
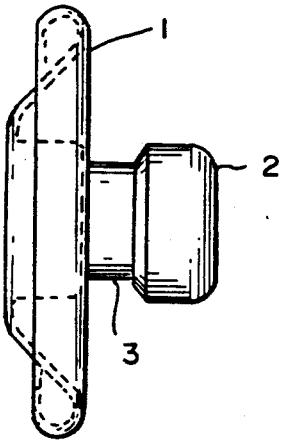
FIG. 3 is a side view of one embodiment of the male component of a snap fastener according to the present invention.
Figure 3A:
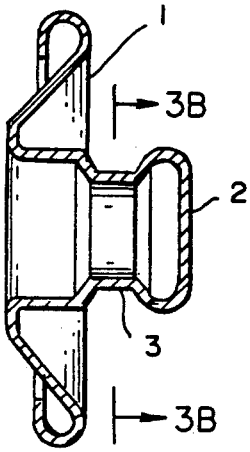
FIG. 3A is an axial cross section of the male component of the snap fastener of FIG. 3.
Figure 3B:
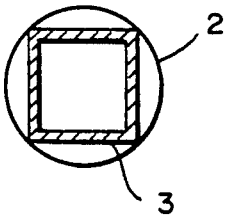
FIG. 3B is a transverse cross section taken along B—B in FIG. 3A.
Figure 4A:
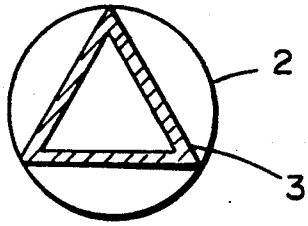
FIGS. 4A–4H are cross sections, similar to FIG. 3B showing neck shapes according to the further embodiments of the invention.
Figure 4B:
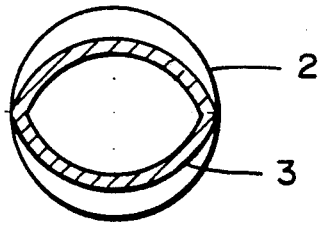
Figure 4C:
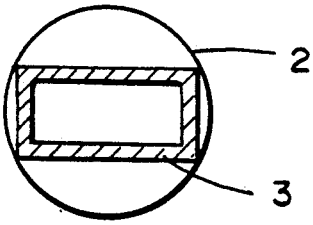
Figure 4D:
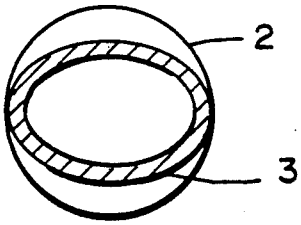
Figure 4E:
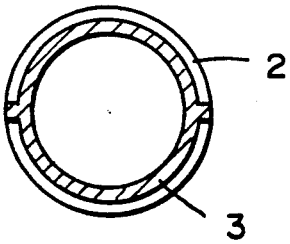
Figure 4F:
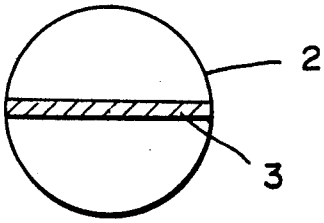
Figure 4G:
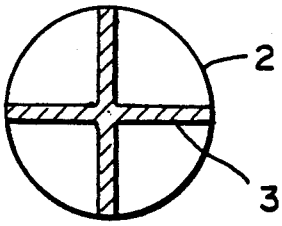
Figure 4H:
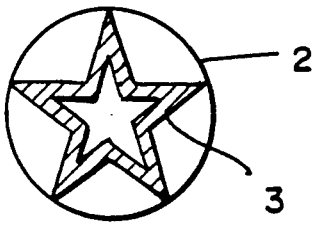

Referring to FIG. 3, 3A and 3B, the neck 3 of the male component has a square cross section, as best shown in FIG. 3C. The square cross section engages slots 8 in a conventional receptacle 7 of a female component 6 such as shown, for example, in FIG. 2B. The engagement of the corners and the slots in the receptacle of the female component prevents either component from rotating with respect to the other. In this way, a removable ornament 4 attached to a garment or bag with the present invention is maintained in its proper rotational orientation.

Referring now to FIGS. 4A–4H, eight other cross sectional shapes of the necks of male components that may be employed in the present invention are shown. All of these shapes are capable of engaging the slots 8 in the receptacle of the conventional female component 5. As illustrated, these include triangular FIG. 4A, elliptical FIG. 4B, rectangular FIG. 4C, oval FIG. 4D circular with projections FIG. 4E, straight line FIG. 4F, cross shaped FIG. 4G, and star shaped FIG. 4H. Cross sectional shapes such as triangular, straight line, rectangular, or, in fact, all shapes other than circular are used effectively in the present invention to prevent the male and female components from turning with respect to each other when mated. Those necks having open centers may alternately be filled with solid material, rather than being open as shown.

It will be clear to one skilled in the art that the necks may be formed solid, without the opening shown in the figures. In this way, there is no need to initially form a neck with an opening that is later filled. The male component may then be formed by joining the solid neck to the remainder.

The remaining figures illustrate the manner in which a removable ornament may be affixed to a component of the present invention and then, using that component, be attached to a garment or bag.

Figure 5A:
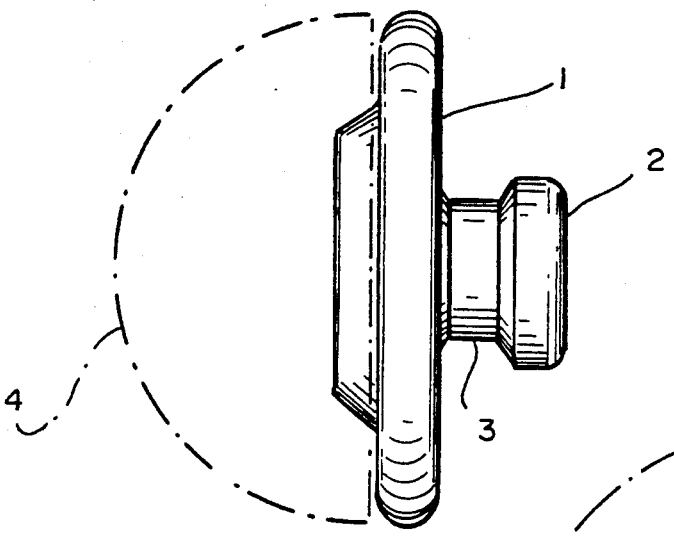
FIG. 5A is a side view of the male component of a snap fastener according to an embodiment of the present invention showing attachment of a phantom ornament.
Figure 5B:
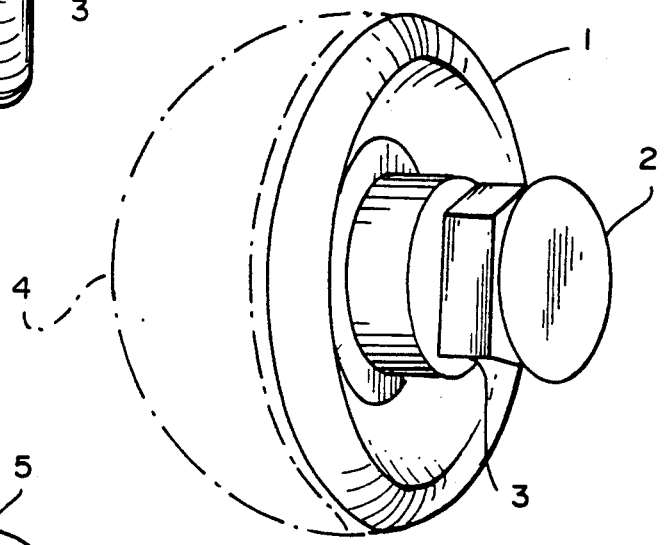
FIG. 5B is an oblique view of the male component of FIG. 5A.

Referring to FIGS. 5A and 5B, a male component 1 of the present invention is affixed to a removable ornament 4 by any convenient conventional means. It will be seen, particularly in FIG. 5B, that the neck 3 has a non-circular shape such as, for example a square. When the male component is connected to a conventional, circular-cross section female component, the corners of the neck 3 engage slots 8 in the female component, thereby preventing relative rotation.

Figure 5C:
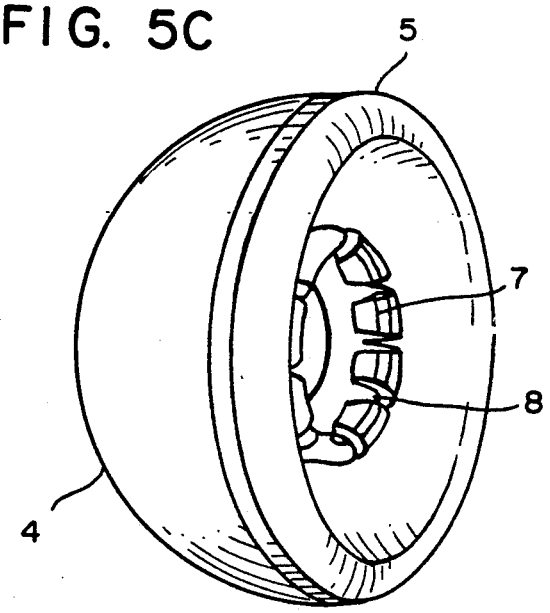
FIG. 5C is an oblique view of a female component of the present invention showing attachment of an ornament.

Referring to FIG. 5C, a conventional female component 5 has an ornament 4 attached thereto. When the conventional female component is mated to a male component according to the invention, the ornament is affixed in a manner that prevents relative rotation of the ornament with respect to the male component.

A comparsion of FIGS. 5A and 5B with FIG. 5C illustrates that the present invention is equally effective with the ornament bonded to either the male or female component, with its mating compoent affixed to the garment or bag. The ornament 4 may be attached to the male or female component of the present invention by any conventional means such as, for example, by bonding, stitching, or any other means appropriate for the ornament.

Referring now to FIg. 6, a typical arrangement of the present invention provides an ornament 4 is to be attached to the male component 1. The ornament is to be secured to a garment or bag by mating with the female component 5. The neck 3 of the male component is square, thus permitting its corners to engage the slots 8 in receptacle 7, preventing the male component and its attached ornament from rotating.

Referring now to FIG. 7A, the ornament 4 is attached to the male component 1. The female component 5 is secured to the fabric 6 of the garment or bag. The ornament can then be readily attached to or removed from the garment or bag by mating or separating the two components. Whenever they are mated, rotation of the ornament with respect to the fabric is prevented.

Referring now to FIG. 7B, the ornament 4 is affixed to the female component 5, and the male component 1 is secured to the fabric 6. As before, the ornament 4 may be attached and detached from the fabric 6. Once attached, however, the ornament 4 is held in a selected rotational orientation until again removed.

The present invention makes it possible to use a number of interchangeable ornaments with a single garment or bag, or to use an ornament with different garments or bags by attaching these ornaments to appropriate components, male or female. In addition, these ornaments can be used with the assurance that they will be maintained in the intended orientation.

What is claimed is:

1. A snap fastener comprising:
a male component;
said male component including a fitting projection;
said fitting projection having a circular cross section;
a neck connecting said fitting projection to a remainder of said male component;
said neck having a non-circular cross section;
a female component;
a receptacle in said female component for receiving said fitting projection;
said receptacle having a circular cross section and including at least one element for engaging said neck; and
said at least one element including means for preventing said male component from rotating with respect to said receptacle.

2. A snap fastener according to claim 1, wherein said means for preventing includes at least one slot.

3. A snap fastener according to claim 1, further including a removable ornament attached to one of said male and female components.

4. A snap fastener according to claim 3, wherein said ornament is attached by bonding.

5. A snap fastener according to claim 3, wherein said ornament is attached by sewing.

6. Apparatus for decorating a fabric comprising:
a snap fastener;
a male component of said snap fastener;
said male component including a fitting projection;
said fitting projection having a circular cross section;

a neck connecting said fitting projection to a remainder of said male projection;

said neck having a non-circular cross section;

a female component of said snap fastener;

a receptacle in said female component for receiving said fitting projection;

said receptacle having a circular cross section and including at least one element for engaging said neck;

said at least one element including means for preventing said male component from rotating with respect to said receptacle;

an ornament; and means for affixing said ornament to one of said male component and said female component;

said means for affixing including means for preventing rotation of said ornament with respect to the component to which it is affixed, whereby said ornament is affixable to said fabric with a selected, non-rotating, orientation.

* * * * *